US008418741B2

(12) United States Patent
Cheung

(10) Patent No.: US 8,418,741 B2
(45) Date of Patent: Apr. 16, 2013

(54) ROLLER BLIND DEVICE

(76) Inventor: Siu Hung Cheung, Hong Kong (HK)

( * ) Notice: Subject to any disclaimer, the term of this patent is extended or adjusted under 35 U.S.C. 154(b) by 0 days.

(21) Appl. No.: 13/197,793

(22) Filed: Aug. 4, 2011

(65) Prior Publication Data

US 2012/0031568 A1 Feb. 9, 2012

(30) Foreign Application Priority Data

Aug. 5, 2010 (CN) ..... 2010 1 0246511

(51) Int. Cl.
*A47G 5/02* (2006.01)

(52) U.S. Cl.
USPC ..... 160/241; 160/245; 160/29

(58) Field of Classification Search ..... 160/241, 160/120, 243, 245, 246, 259, 260, 29, 30, 160/31
See application file for complete search history.

(56) References Cited

U.S. PATENT DOCUMENTS

| | | | | | |
|---|---|---|---|---|---|
| 132,726 | A * | 11/1872 | Landon | 160/241 |
| 362,524 | A * | 5/1887 | Mitter | 160/241 |
| 3,186,473 | A * | 6/1965 | Myers et al. | 160/26 |
| 4,326,577 | A * | 4/1982 | Tse | 160/259 |
| 4,574,864 | A * | 3/1986 | Tse | 160/259 |
| 7,681,618 | B2 * | 3/2010 | Nicolosi | 160/98 |
| 8,205,647 | B2 * | 6/2012 | Carbonini | 141/177 |
| 2012/0031568 | A1 * | 2/2012 | Cheung | 160/121.1 |

* cited by examiner

*Primary Examiner* — Blair M. Johnson

(57) ABSTRACT

The present invention relates to a roller blind device, which comprises a special curtain. The roller blind device also comprises a first circular tube for fixing the upper end of the special curtain and a second circular tube for fixing the lower end of the special curtain. A torsion spiral which is capable of rolling up the special curtain and a stop means for lifting the second circular tube are arranged in the second circular tube. Such structure ensures that the roller blind device can roll up a plurality of roller blind curtains or show one of the plurality of roller blind curtains.

9 Claims, 10 Drawing Sheets

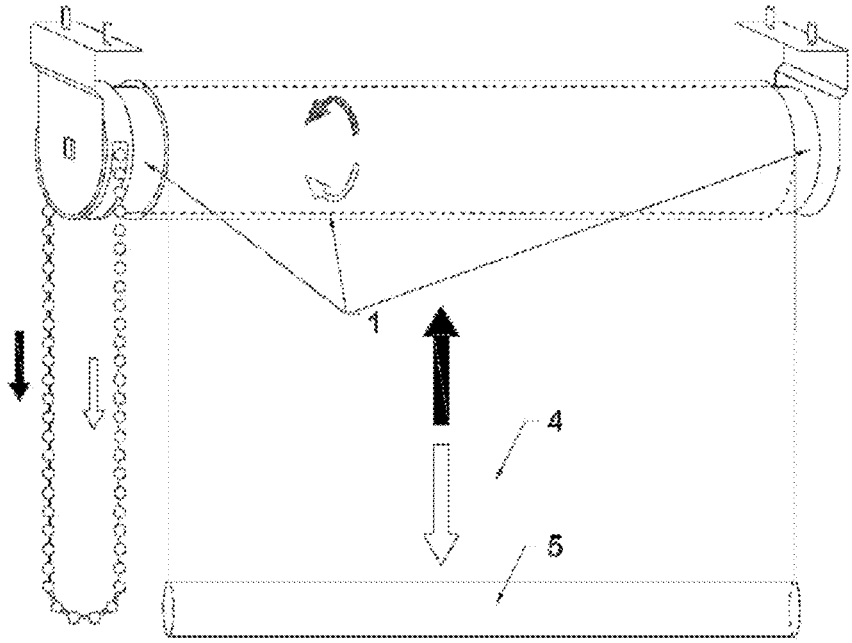
Prior Art Figure 1
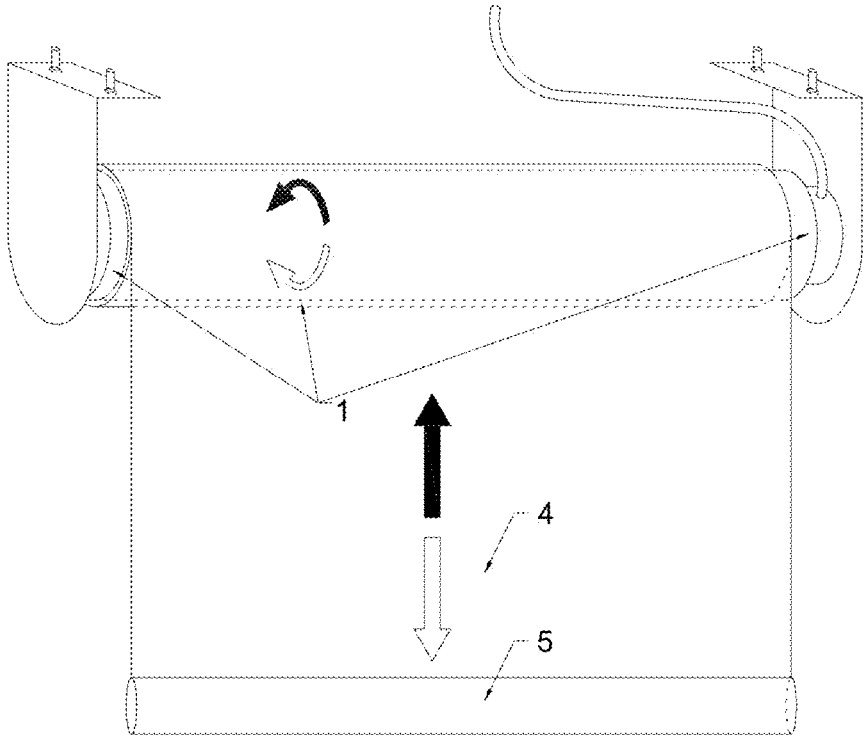
Prior Art Figure 2

ROLLER BLIND DEVICE

FIELD OF THE INVENTION

The present invention relates to a roller blind device, more specifically, to a roller blind device with a plurality of roller blind curtains which can be rolled up or one of which can be shown.

BACKGROUND OF THE INVENTION

A common roller blind is generally classified as a manual one and an electric one. The roller blind shown in FIG. 1 is a manual roller blind. The upper end of a common curtain 4 is fixed to a first circular tube 1 through an adhesive tape and the lower end of the common curtain 4 is fixed to a bottom bar 5. A user can pull a chain to rotate a driver which subsequently rotates the first circular tube 1 to roll up the common curtain onto the first circular tube 1 or to unfold the common curtain 4 away from the first circular tube 1. In this way, the user can choose to roll up or show the common curtain 4 with a size equivalent to that of the window.

FIG. 2 shows an electrical roller blind, which uses a tubular electrical motor to rotate the first circular tube 1. The user can choose to roll up or show one common curtain 4 with a size equivalent to that of the window.

Same or different curtain materials can be jointed together to form a common curtain 4 utilizing an adhesive or sewing or ultrasonic welding.

The present roller blind devices have their own drawbacks and problems, such as they can only roll up or show one common curtain 4 with a size equivalent to that of the window.

SUMMARY OF THE INVENTION

The objective of the present invention is to provide a roller blind device which can roll up a plurality of roller blind curtains or show one of the plurality of roller blind curtains, aiming at the problems in the prior art that the above mentioned roller blind device can only roll up or show one common curtain.

According to an aspect, a roller blind device is provided, which comprising a special curtain; a first circular tube for fixing an upper end of the special curtain and a second circular tube for fixing a lower end of the special curtain; a torsion spiral which is capable of rolling up the special curtain and a stop element for lifting the second circular tube are arranged in the second circular tube.

In the roller blind device of the present invention, the roller blind device comprises an iron baffle, on both ends of which a first connection plate of "Z" shape of a left flexing iron plate and a second connection plate of "Z" shape of a right flexing iron plate are fixed; an included angle between the first connection plate and a first bending plate connected together is a right angle, an included angle between the first bending plate and a third connection plate connected together is a right angle, an included angle between the second connection plate and a second bending plate connected together is a right angle and an included angle between the second bending plate and a fourth connection plate connected together is a right angle; the right flexing iron plate is a mirror of the left flexing iron plate, and two circular iron shafts are fixed symmetrically on the first bending plate and the second bending plate.

In the roller blind device of the present invention, the circular iron shaft comprises a stepped circular shaft; a free-rotating nylon bearing with a groove and a projecting edge for fixing a ribbing and a section of the second circular tube respectively on its external surface, is arranged outside of the stepped circular shaft.

In the roller blind device of the present invention, the left end of an iron square shaft is fixed in the centre square hole of the left circular iron shaft; the iron square shaft is inserted into the right end square hole of the torsion spiral, the left end post of the torsion spiral is fixed in the right side hole of the left nylon bearing.

In the roller blind device of the present invention, the stop element comprises an iron connecting element which is permanently connected with the right end hole of the iron square shaft; an iron screw shaft, the right end of which is cut into a square stem and fixed in the centre square hole of a right circular iron shaft while the left end hole is fixed in the iron connecting element; a nylon supporting runner provided with a groove outside to clamp tightly in the ribbing inside the second circular tube and a circular hole inside to rotate outside of the iron connecting element; and an iron distance-metering gear provided with a groove outside to slide along the ribbing inside the second circular tube and a screw hole at the centre to rotate around the iron screw shaft, the iron distance-metering gear breaks away from or combines with the iron connecting element to enable the second circular tube to rotate or to be lifted and move up and down.

In the roller blind device of the present invention, the weight of the iron baffle is maintained approximately stable with the second circular tube and its internal components by taking the right flexing iron plate or the left flexing iron plate as a lever and taking the special curtain as a fulcrum.

In the roller blind device of the present invention, the locations and weights of the torsion spiral, the iron distance-metering gear, the nylon supporting runner and the iron connecting element are maintained approximately stable by taking the second circular tube as a lever and taking the centre of the special curtain as a fulcrum.

In the roller blind device of the present invention, the both ends of the iron baffle move up and down in the vertical direction along grooves of aluminium alloy tracks of "F" shape on both sides; both flat surfaces of the aluminium alloy track of "F" shape are not reflective.

In the roller blind device of the present invention, the special curtain is made of at least two different curtain materials which are slightly higher than the window.

In the roller blind device of the present invention, there is a circular hole on each of the third connection plate and the fourth connection plate; the circular hole can slide to two iron cones at the same level of the windowsill; the third connection plate and the fourth connection plate fix a bar of supporting aluminium alloy corner by a rivet at the same time.

Implementing the roller blind in the present invention, advantage that a plurality of roller blind curtains can be rolled up or one of which can be shown, can be achieved.

BRIEF DESCRIPTION OF THE DRAWINGS

The present invention will be further described in the following with reference to the accompanying drawings and embodiments. In the Figures:

FIG. 1 is a structure diagram of the manual roller blind of the prior art;

FIG. 2 is a structure diagram of the electric roller blind of the prior art;

DETAILED DESCRIPTION OF THE PREFERRED EMBODIMENT

Figure 3A:
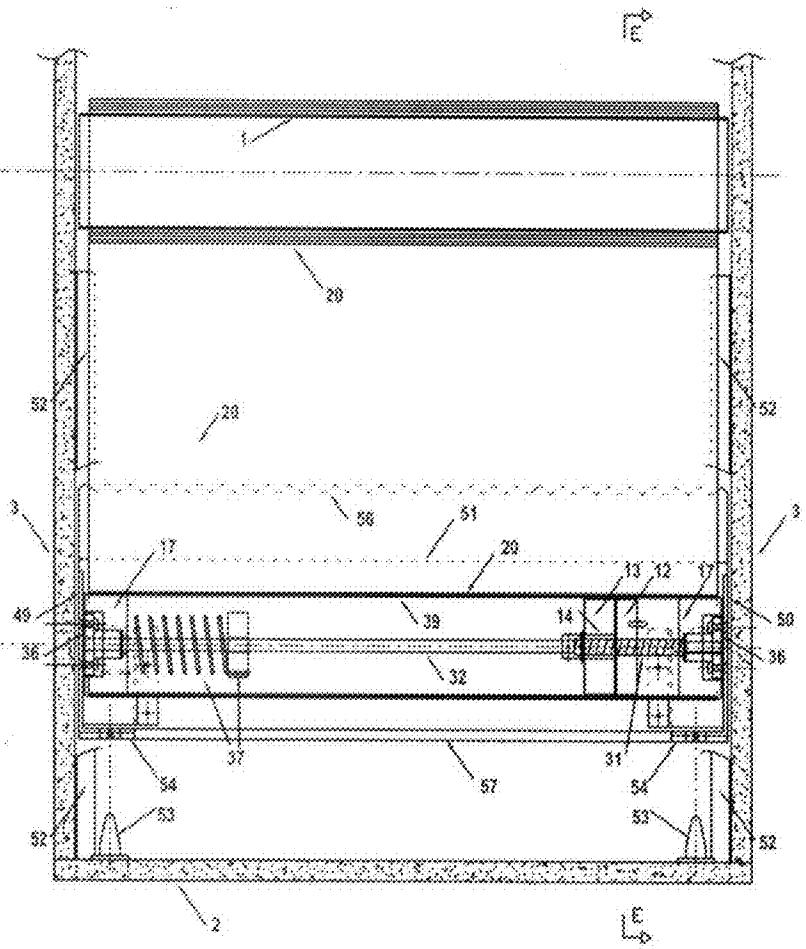
FIG. 3A is the section diagram of the E in FIG. 3B.
Figure 3B:
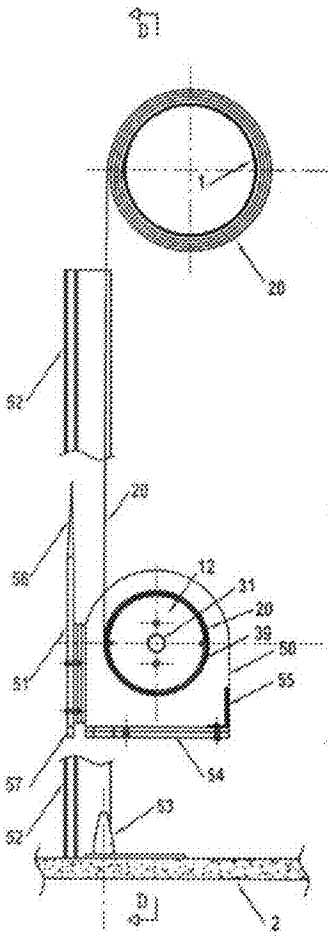
FIG. 3B is the section diagram of the D in FIG. 3A.
Figure 4:
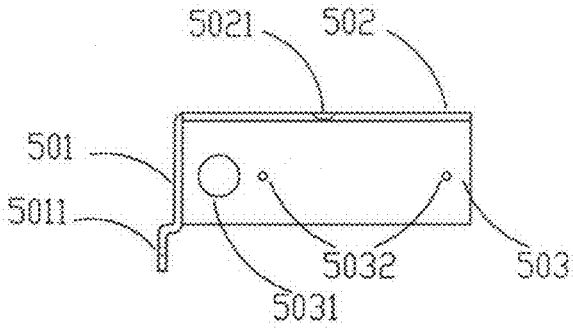
FIGS. 4 to 6 are the exemplary vertical view, front view and right view for the right flexing iron plate of the first embodiment of the roller blind device in the present invention, respectively.
Figure 3C:
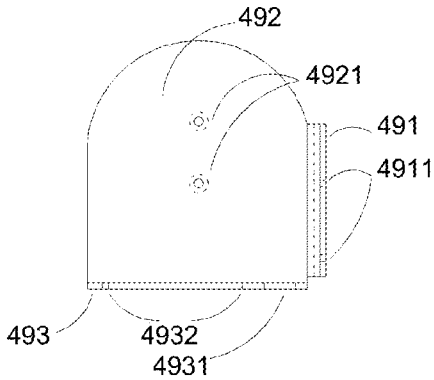
FIG. 3C is the exemplary front view for the left flexing iron plate of the first embodiment of the roller blind device in the present invention, respectively.
Figure 5:
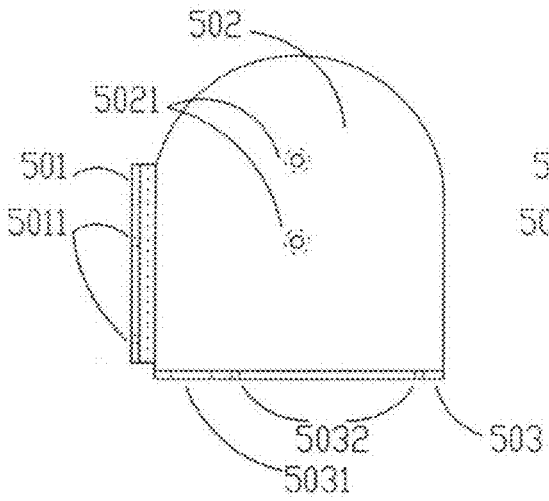
Figure 6:
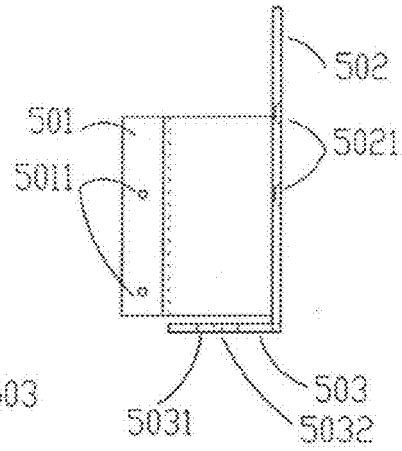
Figure 7:
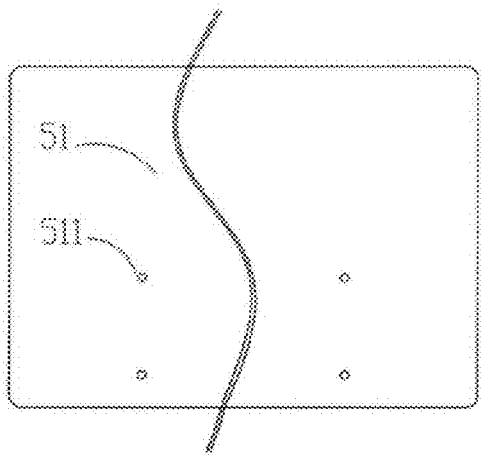
FIGS. 7 to 8 are the exemplary front view and right view for the iron baffle of the first embodiment of the roller blind device in the present invention, respectively.
Figure 8:
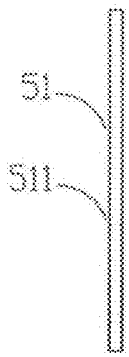
Figure 9:
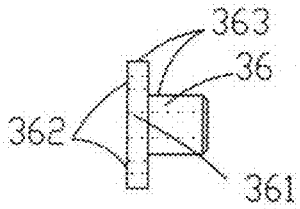
FIGS. 9 to 10 are the exemplary front view and right view for the circular iron shaft of the first embodiment of the roller blind device in the present invention, respectively.
Figure 10:
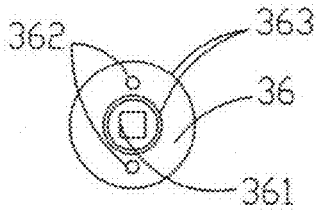
Figure 11:
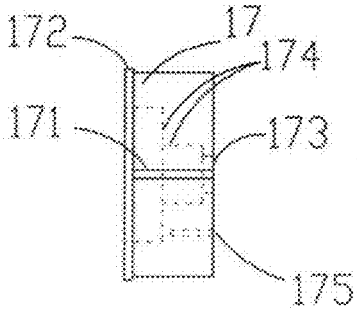
FIGS. 11 to 12 are the exemplary front view and right view for the nylon bearing of the first embodiment of the roller blind device in the present invention, respectively.
Figure 12:
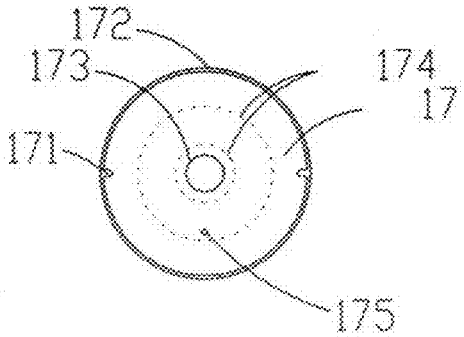
Figure 13:
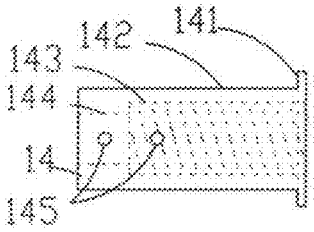
FIGS. 13 to 14 are the exemplary front view and left view for the iron connecting element of the first embodiment of the roller blind device in the present invention, respectively.
Figure 14:
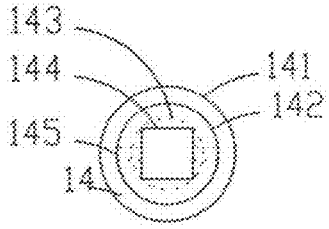
Figure 15:
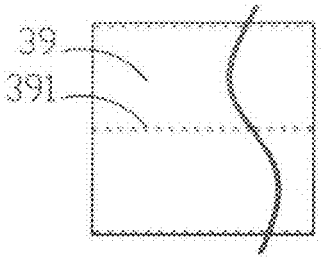
FIGS. 15 to 16 are the exemplary front view and left view for the second circular tube of the first embodiment of the roller blind device in the present invention, respectively.
Figure 16:
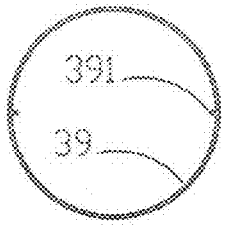
Figure 18:
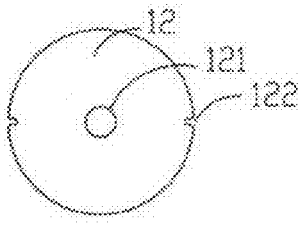
FIGS. 17 to 18 are the exemplary front view and left view for the iron distance-metering runner of the first embodiment of the roller blind device in the present invention, respectively.
Figure 17:
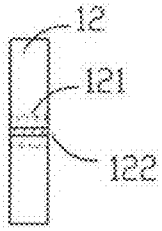
Figure 20:
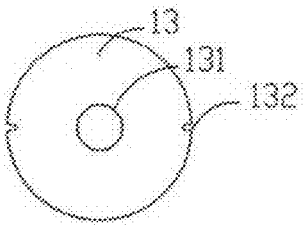
FIGS. 19 to 20 are the exemplary front view and left view for the nylon supporting runner of the first embodiment of the roller blind device in the present invention, respectively.
Figure 19:
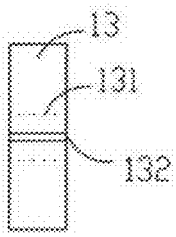
Figure 21:
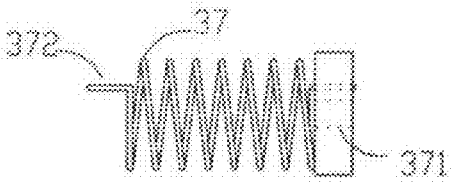
FIGS. 21 to 22 are the exemplary front view and right view for the torsion spiral of the first embodiment of the roller blind device in the present invention, respectively.
Figure 22:
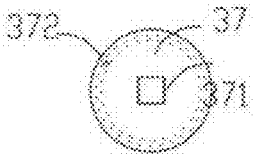
Figure 23:
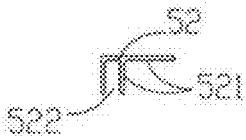
FIGS. 23 to 24 are the exemplary vertical view and front view for the aluminium alloy track of F shape of the first embodiment of the roller blind device in the present invention, respectively.
Figure 24:
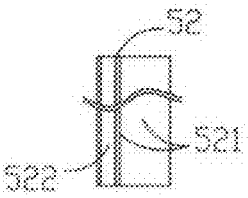
Figure 25:
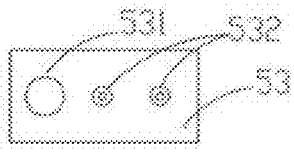
FIGS. 25 to 26 are the exemplary vertical view and front view for the iron cone of the first embodiment of the roller blind device in the present invention, respectively.
Figure 26:
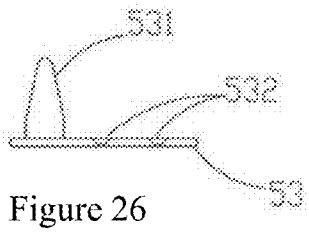
Figure 27:
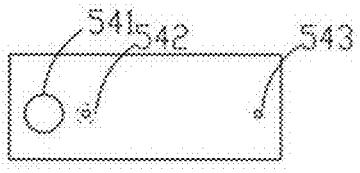
FIGS. 27 to 28 are the exemplary vertical view and right view for the nylon sheet of the first embodiment of the roller blind device in the present invention, respectively.
Figure 28:
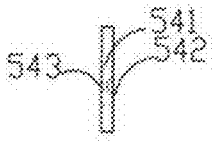
Figure 29:
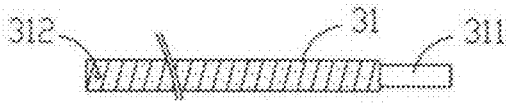
FIGS. 29 to 30 are the exemplary front view and right view for the iron screw shaft of the first embodiment of the roller blind device in the present invention, respectively.
Figure 30:
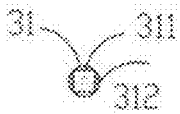
Figure 31:
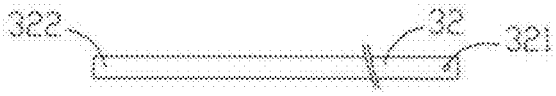
FIGS. 31 to 32 are the exemplary front view and right view for the iron square shaft of the first embodiment of the roller blind device in the present invention, respectively.
Figure 32:
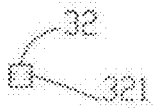
Figure 33:
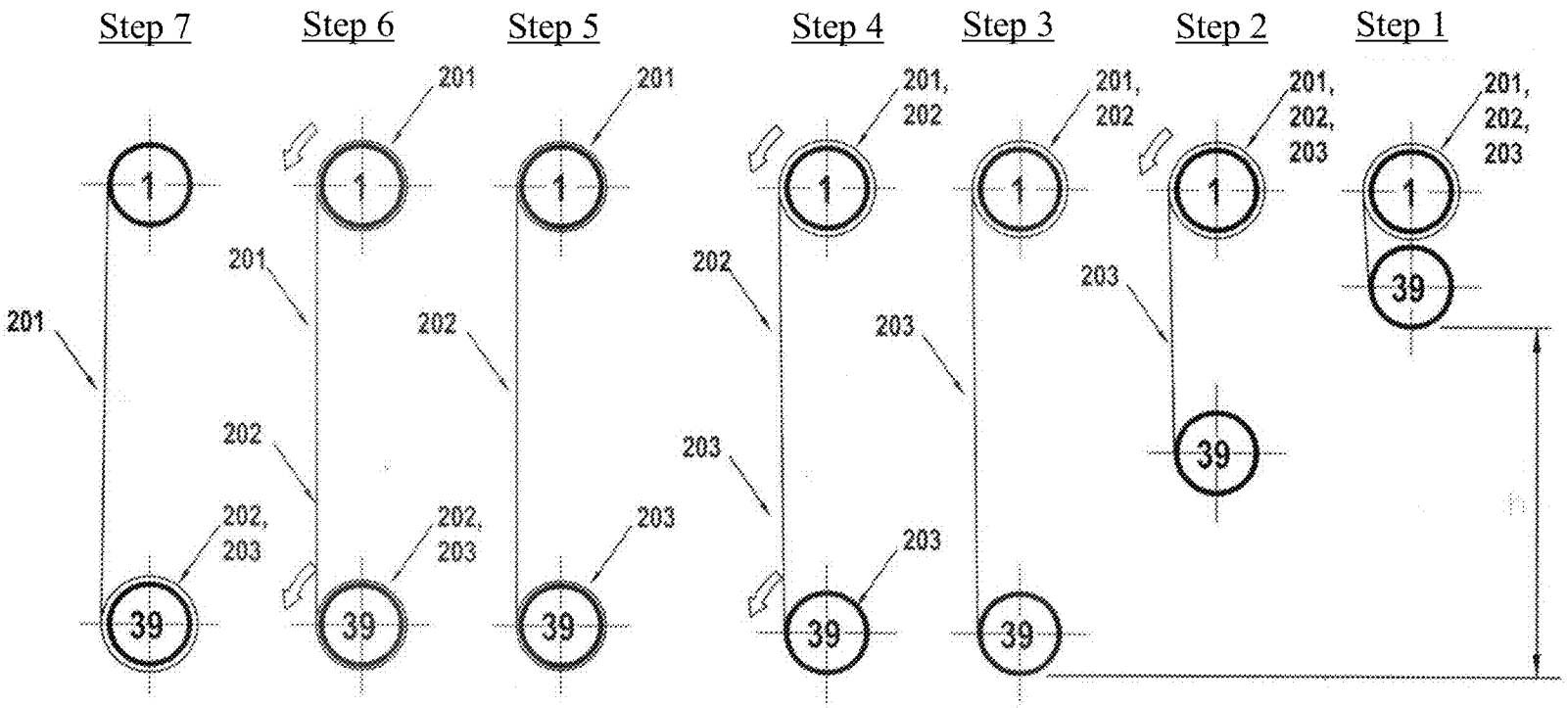
FIG. 33 is the exemplary operation diagram for the step 1 to step 7 in the first embodiment of the roller blind device in the present invention.
Figure 33A:
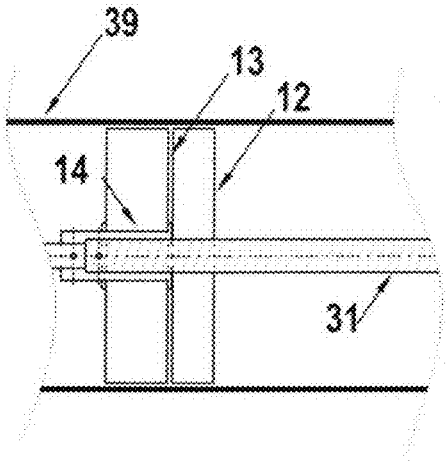
FIG. 33A is the exemplary diagram for the locations of the components of the stop element from step 1 to step 3 in the first embodiment of the roller blind device in the present invention.
Figure 33B:
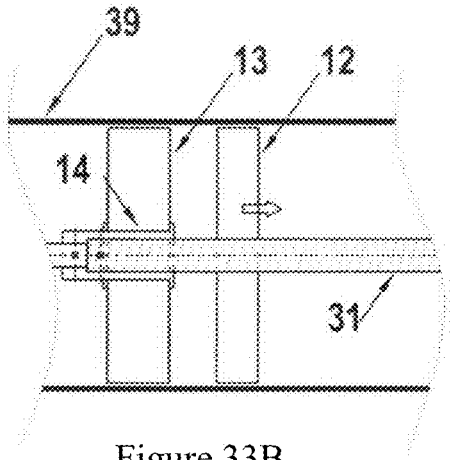
FIG. 33B and FIG. 33C are the exemplary diagrams for the locations of the components of the stop element from step 4 to step 7 in the first embodiment of the roller blind device in the present invention.
Figure 33C:
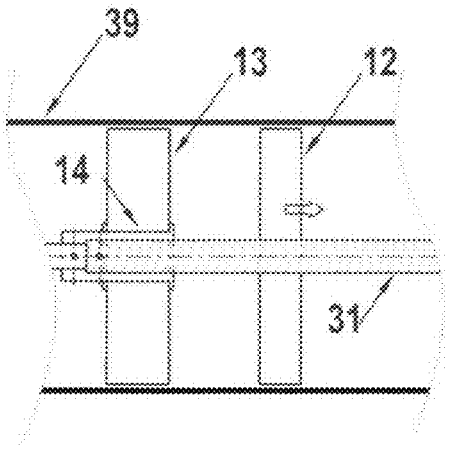
Figure 34:
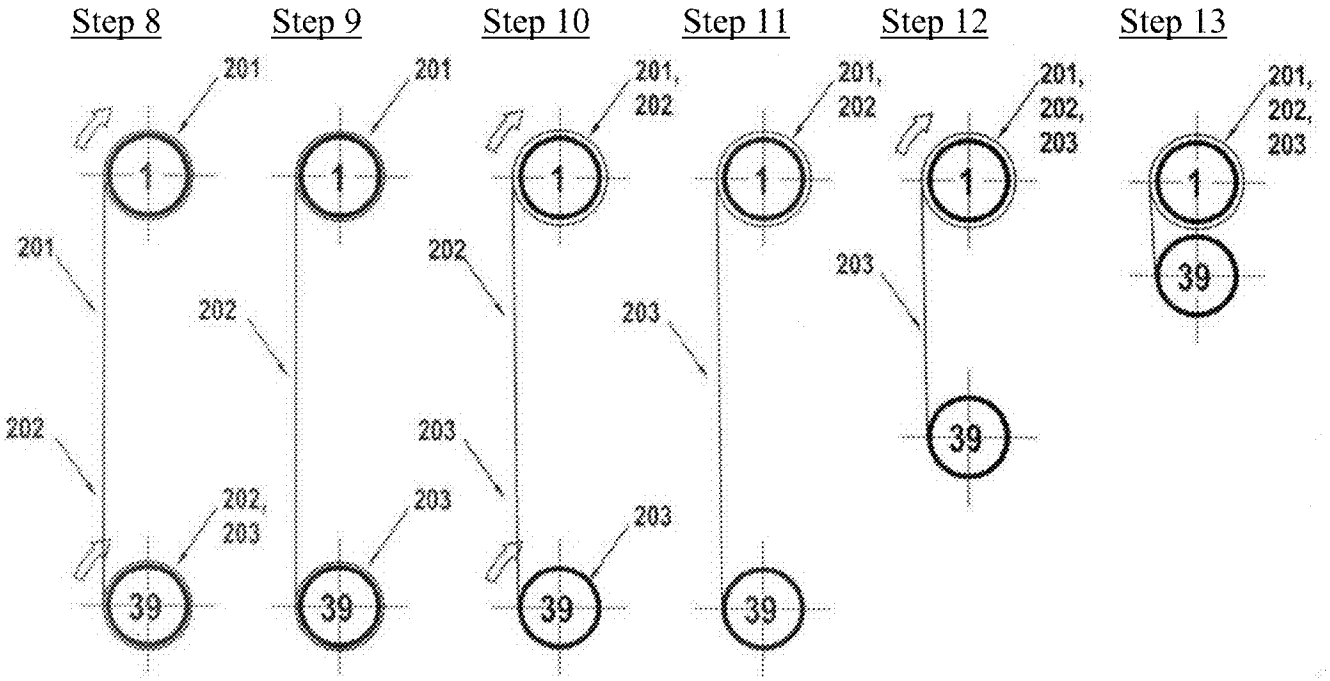
FIG. 34 is the exemplary operation diagram for the step 8 to step 13 in the first embodiment of the roller blind device in the present invention.
Figure 34A:
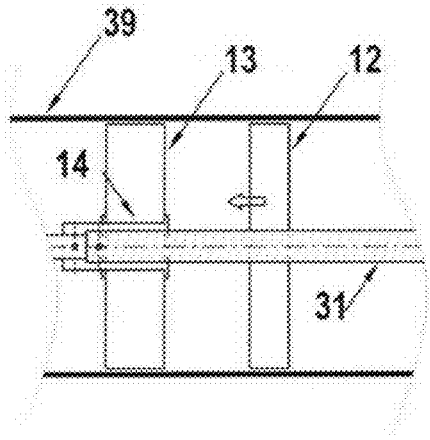
FIG. 34A and FIG. 34B are the exemplary diagrams for the locations of the components of the stop element from step 8 to step 10 in the first embodiment of the roller blind device in the present invention.
Figure 34B:
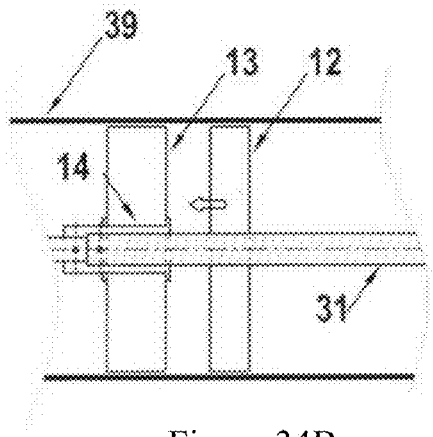
Figure 34C:
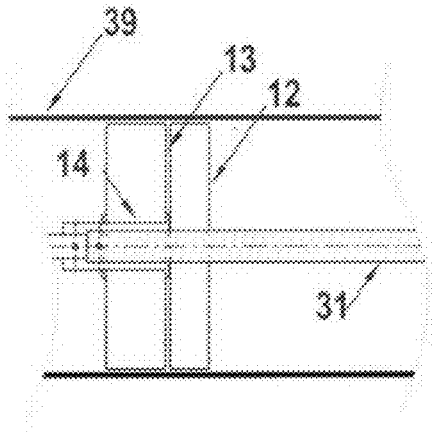
FIG. 34C is the exemplary diagram for the locations of the components of the stop element from step 11 to step 13 in the first embodiment of the roller blind device in the present invention.

The following components can be selected and used in the roller blind device a required:

| Reference number for the accompanying drawing | Component |
|---|---|
| 1 | A first circular tube 1 |
| 2 | Windowsill 2 |
| 3 | Window frame 3 |
| 4 | Curtain of a common roller blind 4 |
| 5 | Bottom bar of a common roller blind 5 |
| 10 | Stop element 10 |
| 12 | Iron distance-metering runner 12 |
| 13 | Nylon supporting runner 13 |
| 14 | Iron connecting element 14 |
| 17 | Nylon bearing 17 |
| 20 | Special curtain 20 |
| 31 | Iron screw shaft 31 |
| 32 | Iron square shaft 32 |
| 36 | Circular iron shaft 36 |
| 37 | Torsion spiral 37 |
| 39 | A second circular tube 39 |
| 49 | Left flexing iron plate 49 |
| 50 | Right flexing iron plate 50 |
| 51 | Iron baffle 51 |
| 52 | Aluminium alloy track of F shape 52 |
| 53 | Iron cone 53 |
| 54 | Option: nylon sheet 54 |
| 55 | Supporting aluminium alloy corner 55 |
| 56 | Option: security hard frosted screen 56 |
| 57 | Option: wool top 57 |

The same reference number for the accompanying drawing in the specific embodiment and the prior art represents the same object.

The present invention will be illustrated detailedly in the following with reference to the accompanying drawings 3A-34C.

Component 1, namely "a first circular tube 1" is an aluminium alloy circular tube used in a common electric or manual roller blind. An adhesive tape is usually used to fix the roller blind curtain to the surface of the circular tube.

Component 2, namely "windowsill 2" is a common windowsill or floor which can fix the iron cone 53.

Component 3, namely "window ribbing 3" is a common window frame or wall which can fix the aluminium alloy track of F shape 52.

Component 4, namely "curtain of a common roller blind 4" is the curtain of a common roller blind which has different options including color, pattern, and transparence and so on. The same or different curtain materials can be jointed together to be one common curtain 4 by utilizing an adhesive or sewing or ultrasonic welding.

Component 12, namely "iron distance-metering runner 12" is a thin electroplated iron cylinder having an outer shape which is the same as but smaller than the internal shape of the second circular tube 39, and therefore the iron distance-metering runner 12 can slide in the second circular tube 39 easily. The iron distance-metering runner 12 is provided with a groove 122 outside and therefore can slide along the ribbing 391 inside the second circular tube 39. The iron distance-metering runner 12 is further provided with a thread 121 at the centre and therefore can rotate around the iron screw shaft 31. The iron distance-metering runner 12 can break away from or combine with the iron connecting element 14, so as to enable the second circular tube 39 to rotate or to be lifted and move up and down.

Component 13, namely "nylon supporting runner 13" is a thin nylon cylinder having an outer shape which is the same as but slightly smaller than the internal shape of the second circular tube 39, and therefore the iron distance-metering runner 12 can slide in the second circular tube 39 easily. The nylon supporting runner 13 is provided with a groove 132 outside and therefore can slide along the ribbing 391 inside the second circular tube 39. The nylon supporting runner 13 is further provided with a circular hole 131 at the centre and therefore can rotate around the iron connecting element 14. The nylon supporting runner 13 also supports the pressure between the second circular tube 39 and the iron connecting element 14.

Component 14, namely "iron connecting element 14" is an electroplated cylinder with a projecting ring 141 at the right end. The external diameter 142 can match the circular hole 131 of the nylon supporting runner 13. A screw hole 143 which can match the iron screw shaft 31 is arranged at one end of the centre of the right side. A square hole 144 which can match the iron square shaft 32 is arranged at the centre of the left side. The iron screw shaft 31, the iron square shaft 32, the ring 141 and the nylon supporting runner 13 can be fixed by iron wires passing through the two circular holes 145.

Component 17, namely "nylon bearing 17" is a nylon circular bearing provided with a groove 171 and a projecting edge 172 for fixing the ribbing 391 and section inside the second circular tube 39 respectively. Two concentric circular holes 174 having different sizes and enabling the circular iron shaft 36 to rotate are arranged at the centre of the left end. A circular hole 173, the diameter of which is larger than those of the iron screw shaft 31 and the iron square shaft 32, is arranged at the centre of the right end. A right side hole 175 which can fix the extension column 372 of the torsion spiral 37 is provided at the left end of the nylon bearing 17.

Component 20, namely "special curtain 20" is a roller blind curtain formed by vertically jointing two or more roller blind curtains with different properties and each height slightly higher than the window. The width of the special curtain 20 is smaller than that of the second circular tube 39.

Component 31, namely "iron screw shaft 31" is an electroplated iron screw shaft with its right end cut into a square stem 311 and a left end hole 312 arranged at its left end. For example, if the special curtain 20 is formed by vertically jointing three roller blind curtains, which are slightly higher than the window, the minimum length of the iron screw shaft 31 can enable the iron distance-metering runner 12 to rotate, so as to roll up at least two (three minus one) roller blind curtains.

Component 32, namely "iron square shaft 32" is an electroplated square iron shaft having a right end hole 321 at its right end.

Component 36, namely "iron shaft 36" is an electroplated iron circular shaft. The electroplated iron circular shaft has a right end 363 with a smaller diameter which enables the circular hole 174 inside the nylon bearing 17 to rotate, and a left end with a larger diameter and two screw holes 362 matching the left flexing iron plate 49 or the right flexing iron plate 50. A square hole 361 enabling the insertion of the left end 322 of the iron square shaft 32 or the right square stem 311 of the iron screw shaft 31 is provided at the center of the iron shaft 36.

Component 37, namely "torsion spiral 37" is a torsion spiral for providing torsion to the second circular tube 39. An extension column 372 extending radically outward is arranged at the left end of the torsion spiral 37. The extension column 372 is inserted into the hole 175 of the nylon bearing 17, and then fixed by a pinch cock and a self tapping screw. An iron piece is arranged at the right end of the torsion spiral 37 and a square hole 371 which is slightly larger than the iron square shaft 32 is arranged at the centre of the torsion spiral 37. A gear group, such as 1:2 can be arranged optionally to reduce the needed revolution time of the torsion spiral.

Component 39, namely "a second circular tube 39" is an aluminium alloy circular tube having one or two ribbings 391 inside.

Component 49, namely "left flexing iron plate 49" is a first connection plate of Z shape 491. The included angle between the left flexing iron plate 49 and the first bending plate 492 connected together is a right angle, and the included angle between the first bending plate 492 and the third connection plate 493 connected together is a right angle. The first connection plate 491 is provided with two holes 4911 and the first bending plate 492 is provided with two holes 4921 while the third connection plate 493 is provided with a large circular hole 4931 and two holes 4932.

Component 50, namely "right flexing iron plate 50" is a second connection plate of Z shape 501. The included angle between the right flexing iron plate 50 and the second bending plate 502 connected together is a right angle, and the included angle between the second bending plate 502 and the fourth connection plate 503 connected together is a right angle. The second connection plate 501 is provided with two holes 5011 and the second bending plate 502 is provided with two holes 5021 while the fourth connection plate 503 is provided with a large circular hole 5031 and two holes 5032. The left flexing iron plate 49 is the mirror of the right flexing iron plate 50.

Component 51, namely "iron baffle 51" is a piece of long iron sheet having two holes 511 at both ends. When the special curtain 20 lifts the second circular tube 39, the moment of inertia of the iron baffle 51 is approximately the same as those of the second circular tube 39 and its internal components. The moment of inertia can be adjusted by changing the height or the thickness of the iron baffle. The left and right ends of the iron baffle 51 can be covered with a nylon sheath to reduce the noise produced when it collides with the aluminium alloy track of F shape 52. An iron horn or an iron groove can be used to enhance strength.

Component 52, namely "aluminium alloy track of F shape 52" is a side trough of F shape. The left and right ends of the iron baffle 51 can insert into the groove of U shape 522. A screw is used to fix the aluminium alloy track of F shape 52 to the window ribbing 3 via passing through the groove of U shape 522. The aluminium alloy track of F shape 52 has two flat surfaces which are not reflective, such as black, to eliminate the reflected sunshine.

Component 53, namely "iron cone 53" can be fixed to the windowsill 2 by a flat screw passing through a hole 532. The horizontal height of the iron cone 53 can be adjusted by a circle at the bottom. A cone 531 can pass through the large circular hole 5031 of the right flexing iron plate 50 (the large circular 4931 of the left flexing iron plate 49).

Component 54, namely "nylon sheet 54" is a piece of rectangular nylon sheet which can reduce the noise produced when the left flexing iron plate 49 (and right flexing iron plate 50) strikes the iron cone 53. The nylon sheet 54 is provided with three circular holes, the position and diameter of which are the same as those of the third connection plate 493 of the left flexing iron plate 49 (the fourth connection 503 of the right flexing iron plate 50), but among which the central hole can match the upward flat screw. The nylon sheet 54 is optional.

Component 55, namely "supporting aluminium corner 55" is an aluminium alloy corner. A hole is arranged at the bottoms of the left and right ends, respectively.

Component 56, namely "security hard frosted screen 56" is a hard nylon frosted screen fixed on the top of the iron baffle 51. Such arrangement can prevent children or users from putting their hands or fingers into the rolling up device. This component is optional.

Component 57, namely "wool top 57" is a common light-blocking wool top which is fixed at the bottom of the iron baffle 51 and covers the gap between the iron baffle 51 and the windowsill 2. The wool top 57 is optional.

A first specific embodiment will be described as follows.

A common roller blind device is assembled without utilizing the common curtain 4 and the bottom bar 5. By means of an adhesive or a sewing machine, three different roller blind curtains are connected into a special curtain 20, the upper end of which is fixed to the first circular tube 1 of a common roller blind. Then the special curtain 20 is rolled up to the first circular tube 1 of the common roller blind, only hanging the special curtain 20 of approximately 300 mm.

The left end of the iron screw shaft 31 is rotated into the screw hole 121 of the iron distance-metering runner 12. The circular hole 131 of the nylon supporting runner 13 slides into the external diameter 142 of the iron connecting element 14, and a circle is added to the left side of the nylon supporting runner 13. The left end of the screw shaft 31 is rotated into the right end of the iron connecting element 14 while the right end of the iron square shaft 32 is inserted into the square hole 144 at the left end of the iron connecting element 14. Components 14, 32, 31 and the circle are fixed by the iron wire that passes through the two circular holes 145 of the iron connecting element 14, the right end hole 321 of the iron square shaft 32 and the left end hole 312 of the iron screw shaft 31. Then the iron distance-metering runner 12 is rotated to close with the iron connecting element 14. Supposing that the special curtain 20 is made of N curtains, therefore, when the iron distance-metering runner 12 is rotated to be away from the iron connecting element 14, the revolution number is the one that ensures the special curtain 20 to be rolled up onto the second circular tube 39 by a minimum of 300 mm and a maximum of the topmost (N-1) curtains.

The left end post 372 of the torsion spiral 37 is fixed in the right side hole 175 of the left nylon bearing 17, and then fixed by a pinch cock and a self tapping screw, while the right end square hole slides into the iron square shaft 32.

The circular iron shaft 36 and the nylon sheet 54 are fixed to the left flexing iron plate 49 and the right flexing iron plate 50 via a countersink head screw, a washer and a screw cap.

The left end of the iron square shaft 32 passes through the left nylon bearing 17, then inserts into the square hole 361 of the circular iron shaft 36. Then the installed iron screw shaft 31, iron distance-metering runner 12, iron connecting element 14, nylon supporting runner 13, iron square shaft 32, torsion spiral 37 and left nylon bearing 17 slide from the left side along the ribbing 391 inside the second circular tube 39. The right nylon bearing 17 is fixed to the right side of the second circular tube 39. The square stem 311 at the right end of the iron screw shaft 31 is inserted into the square hole 361 of the right circular iron shaft 36.

The iron baffle 51, nylon sheet 54 and aluminium alloy corner 55 are fixed to the left flexing iron plate 49 and the right flexing iron plate 50 via a screw or a rivet. The nylon supporting runner 13 is fixed by the flat screw passing through the second circular tube 39. The edge of the screw is firstly abraded to avoid its projection from the second circular tube 39.

The iron distance-metering runner 12 is rotated to close with the iron connecting element 14 and to enable the torsion spiral 37 to create a torsion. By an adhesive tape, the lower end of the special curtain 20 is fixed to the second circular tube 39 which is fixed to the left and right flexing iron plates 49, 50 by an adhesive tape.

When related common roller blind device is installed at building sites, the position of the U shape groove of the aluminium alloy track 52 of F shape can hitch the both ends of the iron baffle tightly. When the aluminium alloy track 52 of F shape has been fixed to the window frame 3 by a self tapping screw or an adhesive, the adhesive tape which fixes the second circular tube 39 to the left and right flexing iron plate 49, 50 is loosened.

The position of the iron cone 53 can match the large circular hole 5031 of the right flexing iron plate 50 and the large circular hole 4931 of the left flexing iron plate 549 respectively. The horizontal height of the windowsill 2 is adjusted by a large circle, and then the iron cone 53 is fixed to the windowsill 2 by a screw.

An "up stop position" is set for the roller blind which is controlled and the first circular tube 1 of which is rotated until the Nth curtain of the special curtain 20 is shown. Then a "low stop position" is set for the roller blind.

When the second circular tube 39 is hung by the special curtain 20, the weight of the iron baffle 51 is maintained approximately stable with the second circular tube 39 and its internal components by taking the right flexing iron plate 50 or the left flexing iron plate 49 as the lever and taking the special curtain 20 as the fulcrum. On the other hand, the locations and weights of the torsion spiral 37, the iron distance-metering gear 12, the nylon supporting runner 13 and the iron connecting element 14 are maintained approximately stable by taking the second circular tube 39 as the lever and taking the centre of the special curtain 20 as the fulcrum.

Options such as the security hard frosted screen 56 and the wool top 57 are fixed as required.

Referring to the accompanying drawings 33, 33A, 33B, 33C, 34, 34A, 34B and 34C, supposing that the special curtain 20 has three different curtains: a top curtain 201, a middle curtain and a bottom curtain 203. The height of the window is "h".

In steps 1-3, the torsion of the torsion spiral 37 is smaller than that produced by the weight of the second circular tube 39 and its internal components. The iron distance-metering runner 12 is close to the iron connecting element 14 and the second circular tube 39 is hung by the special curtain 20.

In steps 4-7, the left and right flexing iron plates 49, 50 rest on the iron cone 53. The first circular tube is rotated to pull down the special curtain 20. Then the torsion spiral 37 can rotate the second circular tube 39 to roll up the special curtain 20. During this, the iron distance-metering runner 12 is rotated away from the iron connecting element 14.

In steps 8-10, the first circular tube 1 is rotated so that the pulled special curtain 20 can pull the second circular tube 30 to rotate. At this time, the torsion of the torsion spiral 37 is smaller than that produced by the special curtain 20. The iron distance-metering runner 12 is rotated close to the iron connecting element 14 again.

In steps 11-13, the second circular tube 39 is hung by the special curtain 20. At this time, the torsion of the torsion spiral 37 is smaller than that produced by the special curtain 20. The iron distance-metering runner 12 is close to the iron connecting element 14.

If necessary, a very thin curtain, such as curtains of HAVERKAMP OPALFILM, can be selected for reducing the thickness of the curtain.

Second embodiment of the special curtain: curtains with different colors or patterns A user can choose different curtains to be the top curtain 201, the middle curtain 202 and the bottom curtain 203 based on the color and pattern and so on.

Third embodiment of the special curtain: curtains with different transparences are automatically selected according to the intensity of sunshine.

A user can choose different curtains to be the top curtain 201, the middle curtain 202 and the bottom curtain 203 according to different transparences. For example, the transparence of the top curtain is 1%, the transparence of the middle curtain is 3%, and the transparence of the bottom curtain is 10%, respectively. In addition, a system that can detect the intensity of sunshine and rotate the motor to a pre-arranged position can be selected and used. Such system includes SMI motor, SOMFY ILT motor, LonWorks control system, Mechoshade control system and so on.

| Intensity of sunshine in front of the special curtain 20 (lux) | Rotation position of the first circular tube 1 up stop position 0% low stop position 100% | Shown curtain of the special curtain 20 | Intensity of sunshine behind the special curtain 20 (lux) |
|---|---|---|---|
| Weak: Such as <1000 | 0% | Not shown | <1000 |
| Low: Such as 1000-10000 | Approximately 37% | Bottom curtain 203 (10%) | 100-1000 |
| Middle: Such as 10000-30000 | Approximately 69% | Middle curtain 202 (3%) | 300-900 |
| High: Such as 30000-90000 | 100% | Top curtain 201 (1%) | 300-900 |

The invention claimed is:

1. A roller blind device, comprising a special curtain (20), wherein, said roller blind device also comprises a first circular tube (1) for fixing an upper end of said special curtain (20) and a second circular tube (39) for fixing an lower end of said special curtain (20); a torsion spiral (37) which is capable of rolling up said special curtain (20) and a stop element (10) for stopping a lifting of said second circular tube (39) are arranged in said second circular tube (39); wherein said roller blind device comprises an iron baffle (51), on both ends of which a first connection plate (491) of "Z" shape of a left flexing iron plate (49) and a second connection plate (501) of "Z" shape of a right flexing iron plate (50) are fixed; an included angle between said first connection plate (491) and a first bending plate (492) connected together is a right angle, an included angle between said first bending plate (492) and a third connection plate (493) connected together is a right angle, an included angle between said second connection plate (501) and a second bending plate (502) connected together is a right angle, and an included angle between said second bending plate (502) and a fourth connection plate (503) connected together is a right angle; said right flexing iron plate (50) is a minor of said left flexing iron plate (49), and two circular iron shafts (36) are fixed symmetrically on said first bending plate (492) and said second bending plate (502).

2. The roller blind device according to claim 1, wherein said circular iron shaft (36) comprises a stepped circular shaft; a free-rotating nylon bearing (17) with a groove (171) and a projecting edge (172) for fixing a ribbing (391) and a section of said second circular tube respectively on its external surface, is arranged outside of said stepped circular shaft.

3. The roller blind device according to claim 2, wherein the left end (322) of a bar of iron square shaft (32) is fixed in the centre square hole (361) of said left circular iron shaft (36); said iron square shaft (32) is inserted into the right end square hole (371) of the torsion spiral (37), the left end post (372) of the torsion spiral is fixed in the right side hole (175) of said left nylon bearing (17).

4. The roller blind device according to claim 3, wherein said stop element (10) comprises an iron connecting element (14) which is permanently connected with the right end hole (32) of said iron square shaft (32); an iron screw shaft (31), the right end of which is cut into a square stem (311) and fixed in the centre square hole (361) of said right circular iron shaft (36) while the left end hole (312) of which is fixed in said iron connecting element (14); a nylon supporting runner (13) provided with a groove (132) outside to clamp tightly in the ribbing (39) inside said second circular tube (39) and a circular hole inside to rotate outside of said iron connecting element (14); and an iron distance-metering gear (12) which is provided with a groove (122) outside to slide along the ribbing (391) inside said second circular tube (39) and a screw hole (121) at the centre to rotate around said iron screw shaft (31), said iron distance-metering gear (12) breaks away from or combines with said iron connecting element (14) to enable said second circular tube (39) to rotate or to be lifted and move up and down.

5. The roller blind device according to claim 4, wherein the weight of said iron baffle (51) is maintained approximately stable with said second circular tube (39) and its internal components by taking said right flexing iron plate (50) or said left flexing iron plate (49) as a lever and taking said special curtain (20) as a fulcrum.

6. The roller blind device according to claim 4, wherein the locations and weights of said torsion spiral (37), said iron distance-metering gear (12), said nylon supporting runner (13) and said iron connecting element (14) are maintained approximately stable by taking said second circular tube (39) as a lever and taking the centre of said special curtain (20) as a fulcrum.

7. The roller blind device according to claim 4, wherein the both ends of said iron baffle (51) move up and down in the vertical direction along grooves (522) of aluminium alloy tracks of "F" shape (52) on both sides; the both flat surfaces of said aluminium alloy track of "F" shape are not reflective.

8. The roller blind device according to claim 1, wherein said special curtain (20) is made of at least two different curtain materials having a length which is slightly higher than a height of the window.

9. The roller blind device according to claim 1, wherein there is a circular hole (4931, 5031) on each of said third connection plate (493) and said fourth connection plate (503); said circular hole (4931, 5031) can slide to two iron cones (53) at the same level of the windowsill (2); said third connection plate (493) and said fourth connection plate (503) fix a bar of supporting aluminium alloy corner (55) by a rivet at the same time.

* * * * *